US005581926A

United States Patent [19]

Taalib-din et al.

[11] Patent Number: 5,581,926

[45] Date of Patent: Dec. 10, 1996

[54] MANUALLY ACTUATED RIFLE

[75] Inventors: Abdul Taalib-din, Detroit; Tchavdar Tchakarov, Monroe; Ronald Wiand, Troy, all of Mich.; Valentin Dimchev, Sofia, Bulgaria

[73] Assignee: Sentinel Arms, B.G., Madison Heights, Mich.

[21] Appl. No.: 308,094

[22] Filed: Sep. 16, 1994

[51] Int. Cl.[6] ..... F41A 3/72

[52] U.S. Cl. ..... 42/16; 42/22

[58] Field of Search ..... 42/16, 17, 18, 42/19, 20, 21, 22; 89/1.4, 1.42, 128, 193

[56] References Cited

U.S. PATENT DOCUMENTS

| | | | |
|---|---|---|---|
| 804,986 | 11/1905 | Stamm | 89/193 |
| 817,198 | 4/1906 | Smith | 89/193 |
| 2,771,819 | 11/1956 | Morse et al. | 42/16 |
| 2,882,635 | 4/1959 | Hill | 42/17 |

FOREIGN PATENT DOCUMENTS

| | | | |
|---|---|---|---|
| 115113 | 3/1949 | Australia | 89/193 |
| 615019 | 12/1948 | United Kingdom | 89/193 |

*Primary Examiner*—Stephen M. Johnson
*Attorney, Agent, or Firm*—Harness, Dickey & Pierce, P.L.C.

[57] ABSTRACT

A manually actuated rifle which maintains the aesthetics of a semi-automatic rifle, but which is incapable of semi-automatic or automatic fire. A piston guide member is provided which has at least one aperture therein for preventing actuation of the action by gas pressure.

18 Claims, 2 Drawing Sheets

MANUALLY ACTUATED RIFLE

BACKGROUND OF THE INVENTION

The present invention relates to firearms. More specifically, the present invention relates to a firearm which is a manually operated single shot firearm by design but maintains the aesthetics of a semi-automatic firearm.

With respect to firearms today, particularly as to rifles there exists two general types of actions for extracting and inserting cartridges out of and into the bore of a barrel. These actions include generally a manual or bolt type action where in a bolt is manually manipulated for each shot or a semi automatic action wherein once the rifle is loaded with a cartridge in the chamber a cartridge is extracted and another cartridge is reinserted upon each pull of the trigger. The semi-automatic firearm category may further be broken down into the types of mechanisms which are used to provide the energy necessary to extract and insert cartridges into the barrel bore. These types of actions include blowback type mechanisms which utilize the recoil energy of firing of the cartridge in order to force the bolt of the action back to extract the cartridge and reinsert a new cartridge in the chamber. A second type of action is a gas operated type mechanism wherein gases from firing of the cartridge are utilized to force the bolt back for extraction of a spent cartridge and reinsertion of a live round in the chamber.

The use of gas operated semi-automatic actions has become commonplace in firearm design today. This has been a result of military research and development of gas operated fully automatic rifles. Gas operated systems lend themselves to useful life in this regard. Thus the advance of the military design of firearms has continued to produce new designs of weapons which allow increased rates of automatic fire and improved lightness, reliability, and other design features. The existence of these features have found desirable applications in the semiautomatic versions of these rifles which are sold in the civilian firearms market. A particular example of this is the Kolashnikov family of rifles, of which many copies have been made throughout the world. Because of the simplicity of the design and inherent reliability, among other features, these rifles have become popular amongst sportsman and gun aficionados in recent years. With the dissolution of the U.S.S.R. and trade barriers falling in Eastern Europe, the availability of semi-automatic versions of Kolashnikov AK-47 style rifles have reached the civilian market at reasonable prices with extremely high quality. A particular example of this is the Bulgarian made SA-93 available from Sentinal Arms, Detroit, Mich.

Although the popularity of such rifles has increased in recent years due to the ready availability of low cost ammunition and low cost rifles. The political climate has been such that these rifle have been under attack by legislative action and the like. Thus while most bolt action and semi-automatic hunting rifles have features which have resulted from military designed rifles such as the Kolashnikov variety, the militarized looking versions and semi automatic versions in particular have been under recent attack and may soon be outlawed. Whereas, the bolt action rifles which utilize the same calibre ammunition as the semi-automatic versions have not been under attack and appear to be politically acceptable. Because of the popularity of the Kolashnikov line of rifles, it has been desirable to produce a rifle which is more politically correct in today's climate, but which retains the overall aesthetics of the well known Kolashnikov rifles to retain its appeal to modern day sportsman.

SUMMARY OF THE INVENTION

In accordance with the present invention there is provided a firearm capable of only manual one shot operation. The firearm includes a receiver and a barrel. The barrel has a bore end, a chamber end and has an axially extending bore. The barrel is attached to the receiver for operably firing of a cartridge. The firearm includes a tubular guide having an interior chamber. The tubular guide is attached to the barrel without any communication which would allow gases to pass through between the bore and the interior chamber. A bolt is provided for insertion and removal of the cartridge from the chamber end of the barrel. A guide rod assembly is provided and is at least partially contained in the tubular guide. The guide rod assembly includes a piston guide member and a spring biasing member which is attached to the piston guide member. The piston guide member includes a piston head and a rod attached thereto. A piston head is axially moveable in the tubular guide. The bolt is operably configured with the guide rod assembly such that the spring biasing member biases the bolt in the direction toward the chamber end of the barrel. Also provided is a manual actuation member attached to the bolt. The firearm of the present invention requires that manual actuation member must be manually actuated after each firing of the rifle in order to remove a spent cartridge or insert a cartridge in the chamber.

It is a goal in the present invention to provide a firearm which maintains the appearance of a semi-automatic firearm but which is not capable of firing or being modified to fire in a semi-automatic fashion. Further goals benefits and advantages of the present invention may be had by reference to the drawings and detailed description of the invention set forth below with reference to the claims appended hereto.

DETAILED DESCRIPTION OF THE INVENTION

In accordance with the present invention there is provided a firearm generally 10 which is capable, only of manual one shot fired operation and must be manually operated often each slot. As will be readily appreciated by those skilled in the art the firearm 10 maintains the aesthetics of an "AK-47" style Kolashnikov rifle but is incapable of modification to a semi-automatic or fully automatic rifle operation.

Figure 1:
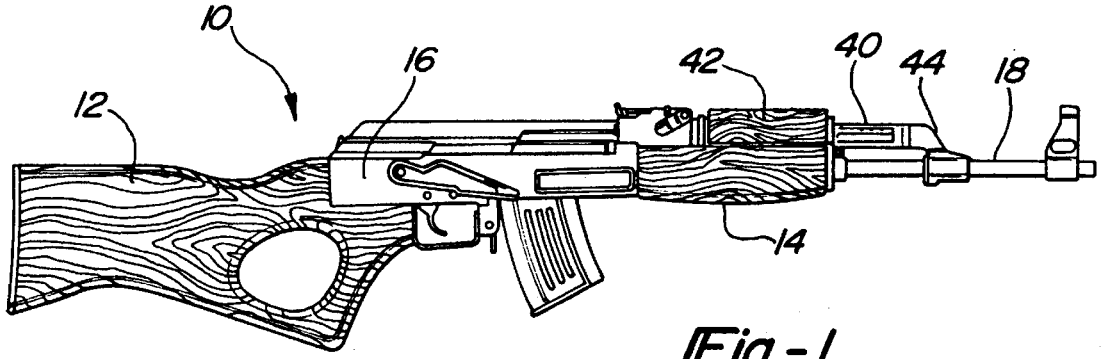
FIG. 1 is a plan view of a firearm in accordance with the present invention.

With reference to FIG. 1, the rifle generally includes a butt stock 12, a fore stock 14, a receiver 16, and a barrel 18. These components are the main components upon which the remaining parts of the rifle are mounted.

Figure 3:
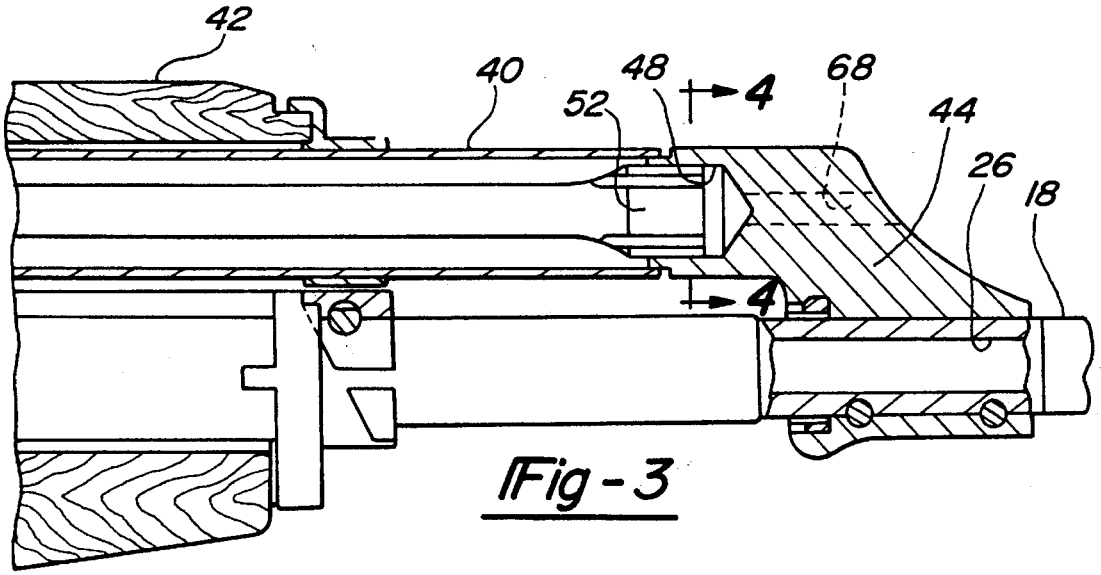
FIG. 3 is a detailed sectional view taken from area 3 of FIG. 2.
Figure 4:
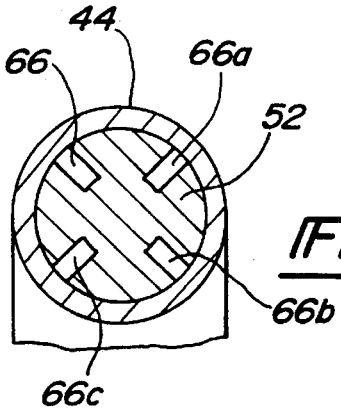
FIG. 4 is a sectional view taken along line 4—4 of FIG. 3.
Figure 2:
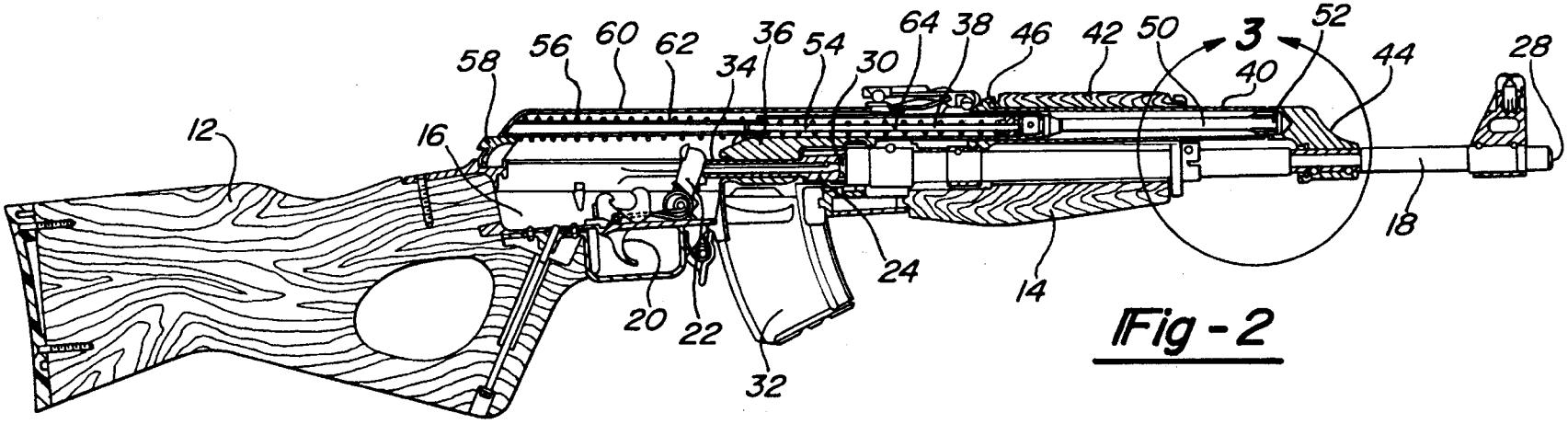
FIG. 2 is a broken away view of the rifle of FIG. 1 showing the operational parts of the rifle with the present invention.
Figure 5:
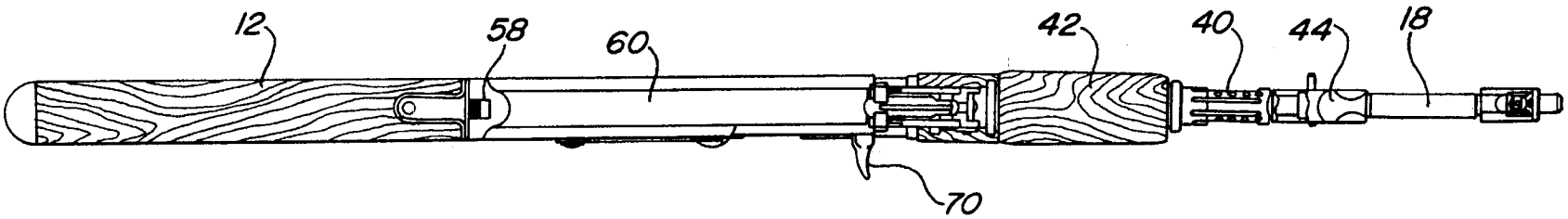
FIG. 5 is a top view of the rifle of the present invention.

Referring to FIG. 2 the receiver portion has many of the operational parts attached to it for firing of a chambered cartridge. These include generally a trigger mechanism shown at 20 which is operably configured with the hammer 22. The hammer 22 strikes the firing pin 24 to ignite a cartridge in the barrel 18. The barrel 18 includes a bore therein 26 (such as shown in FIG. 3). The bore extends axially through the barrel from the bore end 28 to a chamber end 30. As with most firearms the chamber end includes a cartridge size chamber for receiving a predetermined size cartridge from the magazine 32 gun. Magazine 32 contains cartridges and is removably attached to the receiver such that it can be loaded and placed in the receiver for making cartridges available for stripping into the chamber end 30 for firing thereof. The firearm of the present invention includes a conventional rotating bolt 34 which is operationally engaged by bolt carrier 36. The bolt is operably associated with a guide rod assembly generally indicated at 38 which is at least partially contained in a tubular guide member 40. Typically as in other "AK-47" type rifles the tubular guide member 40 is attached to a hand guard 42 and is held in place at the bore end by the attachment member 44 and is secured toward the receiver end by a second attachment 46. An annular chamber 48 is provided at the bore end of attachment member 44.

The guide rod assembly 38 includes a piston guide member 50 with an enlarged piston head 52. The piston guide member 50 is attached to a spring loaded guide rod 54. The guide rod 54 is spring loaded by a helical spring 56 which is retained in the receiver by a tang 58. Tang 58 also provides a rear securement for the receiver cover 60. Guide rod member 44 includes a first cylinder section 62 and a section rod section 64 whereby the rod section 64 may retract into the tube section 62 for providing movement of the bolt 36. The helical spring is engaged between the tang 58 and the rear edge of the piston guide rod 50 such as the bolt and the rod member 64 are biased toward movement toward the bore end of the firearm.

In accordance with the present invention the piston head 52 includes at least one aperture 66 leading from the chamber 48 to the interior of the tubular guide member 40 which would act to dissipate any gases which might erroneously enter chamber 48 such that gases could not force the piston rod 52 back to cycle the action. Additionally, the present invention includes a solid attachment member 44 whereby no communication between the chamber 48 and the bore of the barrel 26 is provided. In a preferred embodiment four axially extending apertures at the radially outer peripheral of the piston are provided as shown by 66, 66*a*, 66*b* and 66*c*. Of course, other apertures may be provided in the piston, providing they allow communication between the interior of the tubular guide member 40 and the chamber 48. Additionally the aperture such as shown in dashed lines by numeral 68, may be provided such that communication with the exterior of the rifle is provided between the chamber 48 through passage 68 or the like. These safeguards act to prevent the modification or use of the rifle in a semi-automatic or automatic mode since any gas which enters chamber 48 would merely blow by the piston and/or out through aperture 68, rather than causing any movement of the piston in response to gaseous pressure forwarded to chamber 48.

In a further alternate embodiment the length of the piston rod is less than the standard length of semi-automatic rifles. Additionally the length of the tube 40 and its mounting to the barrel 18 is less than conventional dimensions such that parts are not interchangeable between the rifle of the present invention and those parts in the semi-automatic version. Thus, in the present invention it is necessary to cycle action after each shot by manually actuating the bolt 36 by way of actuation arm 70 after each shot of the rifle. Thus, in operation the bolt 36 is pulled back by a manual actuation arm 70 and released. This strips a cartridge out of the magazine 32 into the chamber of the barrel 30 and cocks the hammer 22. As will be readily appreciated in this operation the piston 52 moves in a rearward direction towards the butt of the rifle because of the rod member 64 moving in a rearward direction during movement of the bolt 36. Of course the helical spring 56 is compressed during this arrangement which compression provides momentum for the bolt to move to the bolt closed position stripping the cartridge from the magazine 32. Since there is no communication between the chamber 48 and the barrel 26, there is no reaction of the piston 52 during firing of the rifle. Thus, thereafter it is necessary to again manually actuate the bolt 34 via the manual actuation arm 70 to again remove a spent cartridge from the chamber and strip off another cartridge from the clip 32.

The present invention has been described and illustrated manner, using words of description rather than of limitation. Thus, it would be appreciated by those skilled in the art that any modification and variation of the present invention are possible in light of the above teachings. It is therefore to be understood, that within the scope of the appended claims the invention may be practiced otherwise in this specifically described without deviating from the scope of the present invention.

What is claimed is:

1. A firearm capable of only manually cycled operation, said firearm comprising:

a receiver and a barrel, said barrel having a bore end and a chamber end with a bore therethrough, said barrel being attached to said receiver;

a tubular guide having an interior chamber, said tubular guide attached to said barrel without any communication between said bore and said interior chamber;

a bolt for insertion and removal of a cartridge from said chamber end of said barrel;

a guide rod assembly at least partially contained in said tubular guide; said guide rod assembly including a piston guide member and a spring biasing member attached thereto, said piston guide member including a piston head and a rod, said piston head being axially movable in said tubular guide; said tubular guide attached to said barrel by a solid attachment; said solid attachment including a piston chamber therein for receiving said piston head; said bolt being operably coupled with said guide rod assembly such that said spring biasing member biases the bolt in a direction toward said chamber end of said barrel; and a manual actuation member attached to said bolt wherein upon firing of a cartridge gas cannot enter said interior chamber and no movement of said guide rod assembly is accomplished such that said manual actuation member must be manually actuated after each said firing of the rifle in order to remove a spent cartridge or insert a live cartridge in the chamber.

2. The firearm of claim 1 wherein the solid attachment includes an aperture therethrough leading from said chamber to an exterior of said attachment for dissipating any gas pressure which might enter said piston chamber.

3. The firearm of claim 1 wherein said piston head includes an axially extending aperture therethrough to ensure dissipation of gas from said piston chamber.

4. The firearm of claim 3 wherein said aperture of slots includes at least one slot in the radially outer edge of said piston head.

5. The firearm of claim 4 wherein said aperture comprises a plurality of slots in the radially outer edge of said piston head.

6. A firearm capable of only manually cycled operation, said firearm comprising:

a receiver, a barrel attached to said receiver; said barrel including a bore end and a chamber end adjacent to the receiver, said barrel having a bore therethrough along a first axis;

a guide tube, said guide tube attached to said barrel by a first attachment member near said bore end of the said barrel and said guide tube being attached to said barrel at a second location such that an axis of said guide tube is aligned parallel to said bore of said barrel;

a bolt slidable associated with the barrel for sliding in an axial direction allowing for removal and insertion of a cartridge in the axial bore at the chamber end of the barrel;

a spring member for biasing said bolt in a direction toward said chamber end of said barrel;

a guide member operably associated with said spring member for slidable movement in said guide tube, said guide member including a guide rod and a piston head, said first attachment member including a chamber for receiving said piston head therein; said attachment member having no means for providing any communication between the said chamber and the bore of said barrel which would allow gases to pass from said bore to said chamber and said piston head including at least one aperture therethrough for preventing any gases which may enter the chamber from actuating said piston head.

7. The firearm of claim 6 wherein said first attachment member includes a second aperture for communication between said chamber and an exterior portion for venting any gases to prevent gases which enter the chamber from actuating the piston head.

8. The firearm of claim 6 wherein said piston head includes a plurality of axially extending apertures extending therethrough.

9. The firearm of claim 6 wherein said piston head includes a cylindrical face and said aperture comprises a groove in said cylindrical face.

10. The firearm of claim 9 wherein a plurality of grooves are provided about said cylindrical face.

11. A firearm capable of only manually cycled operation, said firearm comprising:

a receiver and a barrel, said barrel having a bore end and a chamber end with a bore therethrough, said barrel being attached to said receiver;

a tubular guide having an interior chamber said tubular guide attached to said barrel without any communication between said bore and said interior chamber;

a bolt for insertion and removal of a cartridge from said chamber end of said barrel;

a guide rod assembly at least partially contained in said tubular guide, said guide rod assembly including a piston guide member and a spring biasing member attached thereto, said piston guide member including a piston head and a rod, said piston head being axially movable in said tubular guide, said bolt being operably coupled with said guide rod assembly such that said spring biasing member biases the bolt in a direction toward said chamber end of said barrel, said piston head including at least one axially extending slot in a radially outer edge of said piston head for dissipation of any gas entering said interior chamber; and a manual actuation member attached to said bolt wherein upon firing of a cartridge gas cannot enter said interior chamber and no movement of said guide rod assembly is accomplished such that said manual actuation member must be manually actuated after each said firing of the rifle in order to remove a spent cartridge or insert a live cartridge in the chamber.

12. The firearm of claim 11 wherein said tubular guide is attached to said barrel by a solid attachment, said solid attachment including a piston chamber therein for receipt of said piston head.

13. The firearm of claim 12 wherein the solid metal attachment includes an aperture therethrough leading from said piston chamber to an exterior of said attachment for dissipating any gas pressure which might enter said piston chamber.

14. The firearm of claim 13 wherein said aperture comprises a plurality of slots in the radially outer edge of said piston head.

15. A firearm capable of only manually cycled operation said firearm comprising:

a receiver, a barrel attached to said receiver, said barrel including a bore end and a chamber end adjacent to the receiver, said barrel having a bore therethrough along a first axis;

a guide tube, said guide tube attached to said barrel by a first attachment member near said bore end of said barrel and said guide tube being attached to said barrel at a second location such that an axis of said guide tube is aligned parallel to said bore of said barrel;

a bolt slidable associated with the barrel for sliding in an axial direction allowing for removal and insertion of a cartridge in the axial bore at the chamber end of the barrel;

a spring member for biasing said bolt in a direction toward said chamber end of said barrel; and a guide member operably associated with said spring member for slidable movement in said guide tube, said guide member including a guide rod and a piston head, said first attachment member including a chamber for receiving said piston head therein, said attachment member having no means for providing any communication between the chamber and the bore of said barrel which would allow gases to pass from said bore to said chamber and said piston head including a plurality of axially extending apertures therethrough for preventing any gases which may enter the chamber from actuating said piston head.

16. The firearm of claim 15 wherein said first attachment member includes a second aperture for communication between said chamber and an exterior portion for venting any gases to prevent gases which enter the chamber from actuating the piston head.

17. The firearm of claim 15 wherein said piston head includes a cylindrical face and said aperture comprises a groove in said cylindrical face.

18. The firearm of claim 17 wherein a plurality of grooves are provided about said cylindrical face.

* * * * *

UNITED STATES PATENT AND TRADEMARK OFFICE

CERTIFICATE OF CORRECTION

PATENT NO. : 5,581,926

DATED : December 10, 1996

INVENTOR(S) : Abdul Taalib-din, et al.

It is certified that error appears in the above-indentified patent and that said Letters Patent is hereby corrected as shown below:

Column 1, Lines 12-13, "where in" should be --wherein--.

Column 1, Lines 13-14, "semi automatic" should be --semi-automatic--.

Column 1, Line 37, "semiautomatic" should be --semi-automatic--.

Column 1, Line 52, "rifles. The" should be --rifles, the--.

Column 1, Line 53, "rifle" should be --rifles--.

Column 1, Lines 57-58, "semi automatic" should be --semi-automatic--.

Column 2, Line 31, "goals" should be --goals,--.

Column 2, Lines 54-55, "often each slot" should be --after each shot--.

Column 3, Line 28, delete "section", first occurrence.

Column 4, Line 18, delete "manner,".

UNITED STATES PATENT AND TRADEMARK OFFICE

CERTIFICATE OF CORRECTION

PATENT NO. : 5,581,926

DATED : December 10, 1996

INVENTOR(S) : Abdul Taalib-din, et al

It is certified that error appears in the above-indentified patent and that said Letters Patent is hereby corrected as shown below:

Column 4, line 23, "in this" should be --than is--.

Signed and Sealed this

Sixth Day of May, 1997

*Attest:*

*Attesting Officer*

BRUCE LEHMAN

*Commissioner of Patents and Trademarks*